US005650256A

United States Patent [19]

Veregin et al.

[11] Patent Number: 5,650,256

[45] Date of Patent: Jul. 22, 1997

[54] TONER PROCESSES

[75] Inventors: Richard P. N. Veregin, Mississauga; Maria N. V. McDougall, Burlington; Francisco E. Torres, Mississauga; Raj D. Patel, Oakville, all of Canada; Grazyna E. Kmiecik-Lawrynowicz, Fairport, N.Y.; T. Hwee Ng, Mississauga; Arthur Helbrecht, Oakville, both of Canada

[73] Assignee: Xerox Corporation, Stamford, Conn.

[21] Appl. No.: 720,646

[22] Filed: Oct. 2, 1996

[51] Int. Cl.[6] ..... G03G 9/087

[52] U.S. Cl. ..... 430/137; 523/335

[58] Field of Search ..... 430/137, 106, 430/110, 111; 523/335

[56] References Cited

U.S. PATENT DOCUMENTS

| | | | |
|---|---|---|---|
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,346,797 | 9/1994 | Kmiecik-Lawrynowicz et al. | 430/137 |
| 5,403,693 | 4/1995 | Patel et al. | 430/137 |

*Primary Examiner*—John Goodrow
*Attorney, Agent, or Firm*—E. O. Palazzo

[57] ABSTRACT

A process for the preparation of toner comprising:

(i) preparing a pigment dispersion, which dispersion is comprised of a pigment, and an ionic surfactant;

(ii) shearing said pigment dispersion with a latex or emulsion blend comprised of resin, a counterionic surfactant with a charge polarity of opposite sign to that of said ionic surfactant and a nonionic surfactant, and wherein said resin contains an acid functionality;

(iii) heating the above sheared blend below about the glass transition temperature (Tg) of the resin to form electrostatically bound toner size aggregates;

(iv) adding anionic surfactant to stabilize the aggregates obtained in (iii);

(v) coalescing said aggregates by heating said bound aggregates above about the Tg of the resin;

(vi) reacting said resin of (v) with acid functionality with a base to form an acrylic acid salt, and which salt is ion exchanged in water with a base or a salt, optionally in the presence of metal oxide particles, to control the toner triboelectrical charge, which toner is comprised of resin and pigment; and (vii) optionally drying the toner obtained.

34 Claims, 1 Drawing Sheet

TONER PROCESSES

BACKGROUND OF THE INVENTION

The present invention is generally directed to toners and toner processes, and more specifically, to aggregation and coalescence processes for the preparation of toner compositions, and wherein the charge on the toner can be increased by washing with base followed by an ion exchange in the presence of optional metal oxide particulates, or particles. In embodiments, the present invention is directed to the economical in situ chemical preparation of toners without the utilization of the known pulverization and/or classification methods, and wherein in embodiments toner compositions with an average volume diameter of from about 1 to about 25, and preferably from 1 to about 10 microns, and narrow GSD of, for example, from about 1.15 to about 1.31 as measured on the Coulter Counter can be obtained. The resulting toners can be selected for known electrophotographic imaging, printing processes, including color processes, and lithography. In embodiments, the present invention is directed to a process comprised of dispersing a pigment in an aqueous mixture containing an ionic surfactant in an amount of from about 0.5 percent (weight percent, or parts throughout unless otherwise indicated) to about 10 percent, and shearing this mixture with a latex or emulsion mixture comprised of suspended submicron resin particles of from, for example, about 0.01 micron to about 2 microns in volume average diameter, wherein the resin particles contains an acid functionality in an aqueous solution containing a counterionic surfactant in amounts of from about 1 percent to about 10 percent with opposite charge to the ionic surfactant of the pigment dispersion, and nonionic surfactant in amounts of from about 0 percent to about 5 percent, thereby causing a flocculation of resin particles and pigment particles, followed by heating at about 5° to about 40° C. below the resin Tg and preferably about 5° to about 25° C. below the resin Tg while stirring of the flocculent mixture which is believed to form statically bound aggregates of from, for example, about 1 micron to about 10 microns in volume average diameter comprised of resin and pigment, and thereafter coalescing by heating the formed bound aggregates about above the Tg (glass transition temperature) of the resin. The size of the aforementioned statistically bonded aggregated particles can be controlled by adjusting the temperature in the below the resin Tg heating stage. An increase in the temperature causes an increase in the size of the aggregated particle. This process of aggregating submicron latex and pigment particles is kinetically controlled, that is the temperature increases the process of aggregation. The higher the temperature during stirring the quicker the aggregates are formed, for example from about 2 to about 10 times faster in embodiments, and the latex submicron particles are picked up more quickly. The temperature also controls in embodiments the particle size distribution of the aggregates, for example the higher the temperature the narrower the particle size distribution, and this narrower distribution can be achieved in, for example, from about 0.5 to about 24 hours and preferably in about 1 to about 3 hours time. Heating the mixture about above or in embodiments equal to the resin Tg generates toner particles with, for example, a volume average particle diameter of from about 1 to about 25 and preferably 10 microns. It is believed that during the heating stage (v), the components of aggregated particles fuse together to form composite toner particles. Subsequently, the toner particles are washed in the presence of the base, such that the toner particles, especially the acid functionality present on the toner surface, is reacted with a base to form an acrylic acid salt, which salt can then be ion exchanged in the presence of optional metal oxide particles, to control the toner triboelectrical charge. In embodiments thereof, the present invention is directed to an in situ process comprised of first dispersing a pigment, such as HELIOGEN BLUE™ or HOSTAPERM PINK™, in an aqueous mixture containing a cationic surfactant, such as benzalkonium chloride (SANIZOL B-50™), utilizing a high shearing device, such as a Brinkmann Polytron, microfluidizer or sonicator, thereafter shearing this mixture with a latex of suspended resin particles containing acid functionality, such as poly (styrene butadiene acrylic acid), poly(styrene butylacrylate acrylic acid), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate (for example NEOGEN R™ or NEOGEN SC™, and a nonionic surfactant, such as alkyl phenoxy poly(ethylenoxy)ethanol (for example IGEPAL 897™ or ANTAROX 897™), thereby resulting in a flocculation, or heterocoagulation of the resin particles with the pigment particles; and which, on further stirring for about 1 to about 3 hours while heating, for example, from about 35° to about 45° C., results in the formation of statically bound toner aggregates ranging in size of from about 0.5 micron to about 10 microns in average diameter size as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. Thereafter, heating from about 5° to about 50° C. above the resin Tg provides for particle fusion or coalescence of the polymer and pigment particles; followed by washing with an optional heating of the water up to about 60° C., wherein the toner particles, especially the acid functionality, particularly acrylic acid, present on the toner surface is reacted with a base like potassium hydroxide to form the acrylic acid salt, which salt is subsequently ion exchanged, in the presence of optional metal oxide particles, such as silica, to control the toner triboelectrical charge. After drying, toner particles comprised of resin and pigment with various particle size diameters can be obtained, such as from 1 to about 20, and preferably 12 microns in average volume particle diameter, are obtained. The aforementioned toners are especially useful for the development of colored images with excellent line and solid resolution, and wherein substantially no background deposits are present. In embodiments, the toner aggregates are washed with diluted base, that is base with water added thereto, which ionizes carboxylic groups on the surface, releases residuals from the surface, and increases the solubility of the surfactants and polyacrylic acid not bounded on the surface of the toner particles, thereby more rapid and more efficient washing with less water can be accomplished; and wherein in embodiments the charge on the toner can be increased by anion exchange of the counterion.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus directed to the use of coagulants, such as inorganic magnesium sulfate, which results in the formation of particles with a wide GSD. Furthermore, the '488 patent does not, it appears, disclose the process of counterionic, for example controlled aggregation is obtained by changing the counterionic strength, flocculation. Similarly, the aforementioned disadvantages, for example poor GSD are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization.

Emulsion/aggregation processes for the preparation of toners are illustrated in a number of patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108, 5,364,729, and 5,346,797.

BRIEF DESCRIPTION OF THE FIGURE

Illustrated in FIG. 1 is the toner aging rate of the toner Example XII compared to the toner aging rate of the toner of Comparative Example XI, wherein Q/M represents the toner tribo.

SUMMARY OF THE INVENTION

Figure 1:
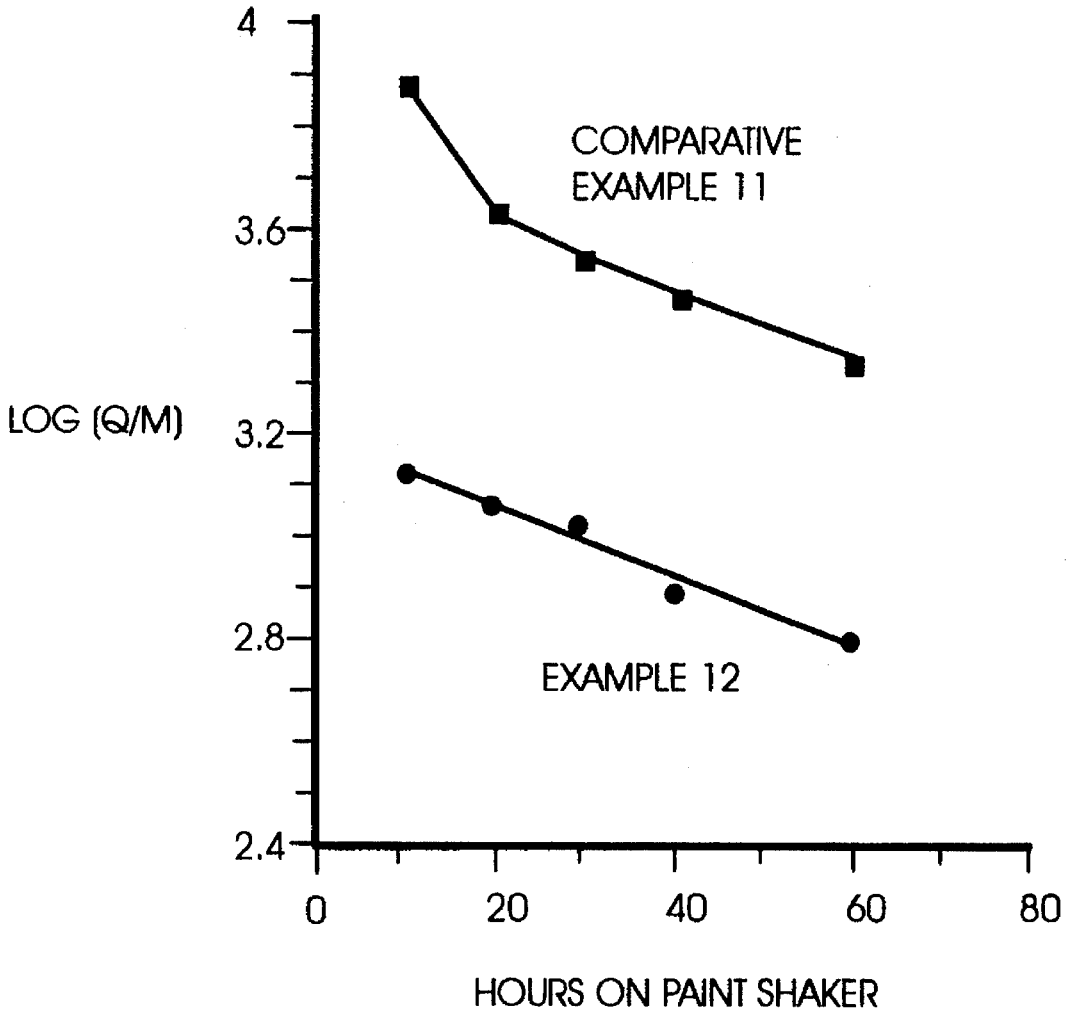

Examples of objects of the present invention in embodiments thereof include:

It is an object of the present invention to provide toners and processes thereof with many of the advantages illustrated herein.

In another object of the present invention there are provided in situ chemical processes for the direct preparation of black and colored toner compositions with, for example, excellent pigment dispersion and narrow, for example 1.15 to 1.31 GSD, and wherein charge control additives and externally dry blended surface additives for controlling, or influencing the charge of the toner are substantially reduced or eliminated.

In another object of the present invention there are provided simple and economical in situ processes for black and colored toner compositions by an aggregation process comprised in the following order of (i) preparing a cationic pigment mixture containing pigment particles, dispersed in a water containing a cationic surfactant by shearing, microfluidizing or ultrasonifying; (ii) shearing the pigment mixture with a latex mixture comprised of a polymer resin, anionic surfactant and nonionic surfactant thereby causing a flocculation of the latex particles with pigment particles, which on further stirring allows for the formation of electrostatically stable aggregates of from about 0.5 to about 5 microns in volume diameter as measured by the Coulter Counter; (iii) adding additional, for example 1 to 10 weight percent of anionic or nonionic surfactant to the formed aggregates to, for example, increase their stability and to retain the particle size and particle size distribution during the heating stage; (iv) coalescing or fusing the aforementioned aggregated particle mixture by heat to toner composites, or a toner composition, or toner particles comprised of resin and pigment; and (v) which toner particles, especially the acid functionality, in particular acrylic acid present on the toner surface, is reacted with a base like potassium hydroxide to form an acrylic acid salt, which salt can be ion exchanged in the presence of metal oxide components to primarily control the toner triboelectrical charge.

In a further object of the present invention there is provided a process for the preparation of toner compositions with an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter, and wherein the toner possesses a stable triboelectric charge of, for example, from about 5 to about 50 microcoulombs per gram, and preferably from about 10 to about 40 microcoulombs per gram.

In a further object of the present invention there is provided a process for the preparation of toner compositions where the triboelectric charge is stable with relative humidity, such that the reduction in charge between 20 percent relative humidity and 80 percent relative humidity is less than about a factor of 2.5, and preferably less than a factor of about 2.

In a further object of the present invention there is provided a process for the preparation of toner compositions with certain effective particle sizes by controlling the temperature of the aggregation which comprises stirring and heating about below the resin glass transition temperature (Tg).

In a further object of the present invention there is provided a process for the preparation of toners with particle size distribution which can be improved from 1.4 to about 1.18 as measured by the Coulter Counter by increasing the temperature of aggregation from about 25° C. to about 45° C.

In a further object of the present invention there is provided a process that is rapid as, for example, the aggregation time can be reduced to below 1 to 3 hours by increasing the temperature from room temperature (RT), about 25° C., to a temperature below 5° to 20° C. Tg, and wherein the process consumes from about 2 to about 8 hours.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment in high yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

These and other objects of the present invention are accomplished in embodiments by the provision of toners and processes thereof. In embodiments of the present invention, there are provided processes for the economical direct preparation of toner compositions by flocculation or heterocoagulation and coalescence, and wherein the temperature of aggregation can be utilized to control the final toner particle size, that is volume average diameter, and which toner, especially the acrylic acid present on the toner surface, is reacted with a base like potassium hydroxide to form an acrylic acid salt, which salt can be ion exchanged, in the presence of metal oxide particles, such as silica, to control the toner triboelectrical charge on the toner.

Embodiments of the present invention include a process for the preparation of toner comprising:

(i) preparing, or providing a pigment dispersion, which dispersion is comprised of a pigment, and an ionic surfactant;

(ii) shearing the pigment dispersion with a latex or emulsion blend comprised of resin, a counterionic surfactant with a charge polarity of opposite sign to that of said ionic surfactant and a nonionic surfactant, and wherein said resin contains an acid functionality;

(iii) heating the above sheared blend below about the glass transition temperature (Tg) of the resin to form electrostatically bound toner size aggregates with a narrow particle size distribution;

(iv) adding extra anionic surfactant in the range amount of about 0.1 to 5 weight percent of the reactor contents to primarily stabilize the aggregates obtained in step (iii) when further heated;

(v) coalescing by heating the bound aggregates above about the Tg of the resin;

(vi) reacting the obtained toner resin of (v) with acid functionality with a base to form an acrylic acid salt, and which salt is ion exchanged in water with a base or a salt, and optional metal oxide particles, to control the toner triboelectrical charge; and (vii) optionally drying the toner obtained; a process for the preparation of toner comprising:

(i) preparing, or providing a pigment dispersion, which dispersion is comprised of a pigment, and an ionic surfactant;

(ii) shearing said pigment dispersion with a latex blend comprised of resin, a counterionic surfactant with a charge polarity of opposite sign to that of said ionic surfactant and a nonionic surfactant, and wherein said resin contains an acid functionality;

(iii) heating the above sheared blend below about the glass transition temperature (Tg) of the resin to form aggregates;

(iv) adding further anionic surfactant in the range amount of from about 0.1 to about 5 percent by weight of the reactor contents in order to primarily stabilize the aggregates obtained in (iii) when further heated;

(v) heating and coalescing the aggregates above about the Tg of the resin;

(vi) reacting the acid functionality with a base to form an acrylic acid salt; and optionally (vii) isolating and drying the toner; and a process for the preparation of toner comprising:

(i) shearing a pigment dispersion with a latex blend and wherein the pigment dispersion is comprised of a pigment and an ionic surfactant, and wherein the latex blend is comprised of resin, a counterionic surfactant with a charge polarity of opposite sign to that of said ionic surfactant and a nonionic surfactant, and wherein said resin contains an acid functionality;

(ii) heating the above sheared blend below about the glass transition temperature (Tg) of the resin to form aggregates;

(iii) adding stabilizer, that is anionic surfactant, to stabilize the aggregates upon further heating;

(iv) heating the aggregates above about the Tg of the resin;

(v) reacting said acid functionality with a base to form an acrylic acid salt; and optionally (vi) isolating and drying the toner.

In embodiments, the present invention is directed to processes for the preparation of toner compositions, which comprises initially attaining or generating an ionic pigment dispersion, for example dispersing an aqueous mixture of a pigment or pigments, such as carbon black like REGAL 330®, phthalocyanine, quinacridone or RHODAMINE B™ type with a cationic surfactant, such as benzalkonium chloride, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of polymer components, such as poly(styrene butylacrylate), and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5° to about 15° C., and allowing the formation of electrostatically stabilized aggregates ranging from about 0.5 micron to about 10 microns; followed by heating above about the resin Tg, for example from about 5° to about 50° C., to cause coalescence of the latex, pigment particles and followed by washing, and which toner, especially the acrylic acid present on the toner surface, is reacted with a base like potassium hydroxide to form the acrylic acid salt, which is ion exchanged, in the presence of metal oxide particles to control the toner triboelectrical charge; followed by washing with hot water at a temperature of from about 40° to about 75° C. to remove, for example, surfactants, and drying, such as by use of an Aeromatic fluid bed dryer, freeze dryer, or spray dryer, whereby toner particles comprised of resin and pigment with various particle size diameters can be obtained, such as from about 1 to about 10 microns in volume average particle diameter as measured by the Coulter Counter.

The reaction of the acrylic acid with a base can be accomplished by a number of methods, for example by washing the toner particles with water, wherein the pH of the water has been adjusted with a base, or with a mixture of bases, $M^{+n}(OH)_n$, where $M^{+n}$ is any metal ion with charge +n. Examples of bases that can be utilized are lithium hydroxide, sodium hydroxide, potassium hydroxide, calcium hydroxide, barium hydroxide, cesium hydroxide, and aluminum hydroxide. Other bases that could be selected are triethanolamine, ammonia, urea, pyridine, guanadine, sodium carbonate, potassium bicarbonate, and triethylamine. The amount of base selected can be varied to adjust the pH of the water of from about 7 to about 11. The reaction with base can be accomplished at elevated temperatures up to about 5° to 10° C. below the Tg for reaction times of from about 10 minutes to about 6 hours. The amount of water used to the amount of toner in each washing step may be varied from about 1 to 1 to about 20 to 1 by weight. The primary result and advantage of the reaction of base with acrylic acid is a more efficient removal of surfactants, and the conversion of the acrylic acid to an acrylic acid salt. The acrylic acid salt can undergo a further ion exchange, wherein the toner particles are washed with an ionic solution, where the ionic solution comprises an ionic salt, $(M^{+n})X_n$, where $M^{+n}$ is any metal ion with charge +n, and X is a halogen, or of a base of the form $M^{+n}(OH)_n$, where $M^{+n}$ is any metal ion with charge +n, wherein n can be from 1 to about 4, or a mixture of a salt and a base. Examples of suitable ionic salts are LiCl, NaCl, KCl, CsCl, $MgCl_2$, $CaCl_2$, $FeCl_3$, $CuCl_2$, $ZnCl_2$, NaBr, KBr, KI, and $BaCl_2$. The amount of salt that can be utilized can be from about 0.1 to about 10 weight percent per weight percent toner. Examples of bases that can be utilized are lithium hydroxide, sodium hydroxide, potassium hydroxide, calcium hydroxide, barium hydroxide, cesium hydroxide, and aluminum hydroxide. The amount of base used for the ion exchange can be varied to adjust the pH of the water from about 7 to about 13. The ion exchange reaction can be accomplished at elevated temperatures up to about 5° to 10° C. below the Tg for reaction times of from about 10 minutes to about 6 hours. The amount of water used to the amount of toner in each washing step may be varied from about 1 to 1 to about 20 to 1 by weight. In the ion exchange step, there may be an optional metal oxide particulate present, which can be comprised of a silicon dioxide, aluminum oxide, titanium dioxide, zirconium dioxide, tin oxide, iron oxide, and magnetite, or a combination thereof. The oxide may be hydrophilic, or may be a surface treated oxide, including hydrophobically modified oxides. The amount of examples of specific metal oxides that may be used include Degussa R972, R974, R812, A380, A300, A200, A100, OX50, MOX80, T805, P25, and Aluminum Oxide C, Cabot TS530, Wacker HDK H 1303 VP and HDK 50 650 VP, H2000, H2015, H2050, H3004, H15, H20, H30, S13, V13, N20, T30, and T40. The amount of metal oxide particles that can be used is from about 0.2 percent by weight to about 4 percent by weight.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); polymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc.), a polyester resin; PLASTHALL™ (Rohm & Hass), a polyester; CYGLAS™ (American Cyanamid Company), a polyester molding compound; ARMCO™ (Armco Composites), a polyester; CELANEX™ (Celanese Eng), a glass reinforced thermoplastic polyester; RYNITE™ (DuPont), a thermoplastic polyester; STYPOL™ (Freeman Chemical Corporation), a polyester with styrene monomer, and the like. The resin selected, which generally can be in embodiments styrene acrylates, styrene butadienes, styrene methacrylates, are present in various effective amounts, such as from about 85 weight percent to about 98 weight percent of the toner, and can be of small average particle size, such as from about 0.01 micron to about 1 micron in volume average diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and a monomer with acid functionality, such as acrylic acid, and methacrylic acid, and optional basic olefinic monomers, such as acrylic acid, methacrylic acid, acrylamide, methacrylamide, quaternary ammonium halide of dialkyl or trialkyl acrylamides, or methacrylamide, vinylpyridine, vinylpyrrolidone, vinyl-N-methylpyridinium chloride, and the like. The acid groups, or group can be present in various amounts of from about 0.1 to about 10 percent by weight of the polymer resin, and the optional basic groups, or group can be present in substantially similar amounts. The presence of acid or basic groups is optional and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™; MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the polymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, or stabilizer which are added to the aggregated particles to freeze, stabilize, or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregate comprised of resin latex, pigment particles, water, ionic and nonionic surfactants mixture.

Surface additives that can be added to the toner compositions after washing and/or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

Toner Charging Evaluation

In a 120 milliliter glass bottle, 1 gram of toner was added to 24 grams of carrier particles comprised of 65 micron steel particles coated with a mixture of 20 percent by weight of VULCAN carbon black and 80 weight percent of polymethylmethacrylate, and wherein the carrier coating weight was 1 percent. The toner and carrier were retained in an environmental chamber at either 20 percent relative humidity, or 80 percent relative humidity overnight, about 18 hours. The bottle was then sealed, and the toner and carrier particles were mixed by roll milling for 30 minutes to obtain a stable triboelectric charge. The toner charge was measured using the standard Faraday cage tribo blow-off apparatus.

Latex Preparation:

A polymeric or emulsion latex was prepared by the emulsion polymerization of styrene/butylacrylate/acrylic acid (82/18/2 parts) in nonionic/anionic surfactant solution (3 percent) as follows. 98.4 Kilograms of styrene, 21.6 kilograms of butyl acrylate, 2.4 kilograms of acrylic acid, 4.2 kilograms of dodecanethiol and 1.2 kilograms of carbon tetrabromide were mixed with 180 kilograms of deionized water in which 2.7 kilograms of sodium dodecyl benzene sulfonate anionic surfactant (NEOGEN R™ which contains 60 percent of active component), 2.58 kilograms of polyoxyethylene nonyl phenyl ether—nonionic surfactant (ANTAROX 897™—70 percent active), and 1.2 kilograms of ammonium persulfate initiator were dissolved. The emulsion was then polymerized at 70° C. for 6 hours. The resulting latex, 60 percent water and 40 percent (weight percent throughout) solids, was comprised of a copolymer of polystyrene/polybutyl acrylate/polyacrylic acid, 82/18/2; the Tg of the latex dry sample was 53.1° C., as measured on a DuPont DSC; $M_w$=21,600 and $M_n$=1,200 as determined on Hewlett Packard GPC. The zeta potential as measured on Pen Kem Inc. Laser Zee Meter was −80 millivolts for the polymeric latex. The particle size of the latex as measured on Brookhaven BI-90 Particle Nanosizer was 167 nanometers.

Preparation of Toner Size Particles: Toner A

13 Kilograms of the prepared latex was then simultaneously added with 15.67 kilograms of a pigment dispersion comprised of 3.55 kilograms of yellow 17 pigment, and which dispersion had a solids content of 21 percent, 120 grams of cationic surfactant (SANIZOL B™), and 12 kilograms of deionized water into a reactor containing 20 kilograms of deionized water while being sheared by an in line homogenizer and recirculated. The shearing was continued for 15 minutes, after which the reactor temperature was raised from room temperature to 52° C. at the rate of 1.0° C./minute and held there for 105 minutes to perform the aggregation. The particles size of the aggregates measured was 7.1 microns with a GSD of 1.23. 625 Grams of anionic surfactant NEOGEN R™ (60 percent active ingredients) were dissolved in 3.125 kilograms of water, resulting in a 20 percent surfactant solution, which was added to the reactor to stabilize the aggregates. The reactor temperature of the reactor was then raised to 93° C. and held there for a period of 4 hours. The measured particle size of the resulting coalesced fused aggregates was 7.0 microns (volume average diameter) with a GSD of 1.25

Preparation of Toner Size Particles: Toner B

15 Kilograms of latex were simultaneously added with 14.38 kilograms of the pigment dispersion comprised of 438 grams of cyan pigment (BHD 6000) with a solids content of 53.4 percent, 145 grams of cationic surfactant (SANIZOL B™), and 13.8 kilograms of deionized water into a reactor containing 23 kilograms of deionized water while being sheared by an in line homogenizer and recirculated. The shearing was continued for 15 minutes, after which the reactor temperature was increased from room temperature to 50° C. at the rate of 1.0° C./minute and held there for 82 minutes to perform the aggregation. The particles size of the aggregates measured was 6.6 microns with a GSD of 1.23. 337 Grams of anionic surfactant NEOGEN R™ (60 percent active ingredients) were dissolved in 1.682 kilograms of water, resulting in a 20 percent surfactant solution, which was then added to the reactor, to primarily stabilize the aggregates. The reactor temperature was then raised to 93° C. and held there for a period of 4 hours. The measured particles size of the fused toner aggregates was 6.5 microns with a narrow GSD of 1.20.

Preparation of Toner Size Particles: Toner C

15 Kilograms of latex were simultaneously added with 14.38 kilograms of the pigment dispersion comprised of 438 grams of cyan pigment (BHD 6000) having a solids content of 53.4 percent, 145 grams of cationic surfactant (SANIZOL B™), and 13.8 kilograms of deionized water into a reactor containing 23 kilograms of deionized water while being sheared by an in line homogenizer and recirculated. The shearing was continued for 15 minutes, after which the reactor temperature was raised from room temperature to 50° C. at the rate of 1.0° C./minute and held there for 50 minutes to perform the aggregation. The measured particle size of the resulting aggregates was 4.8 microns with a GSD of 1.19. 375 Grams of anionic surfactant NEOGEN R™ (60 percent active ingredients) were dissolved in 1.875 kilograms of water, resulting in a 20 percent surfactant solution, which was added to the reactor, in order to stabilize the aggregates. The reactor temperature of the reactor was then raised to 93° C. and held there for a period of 4 hours. The measured particle size of the fused aggregates was 4.9 micron with a GSD of 1.25.

Treatment of Toner Particles:

COMPARATIVE TONER EXAMPLE 1

The filtered yellow Toner A particles were washed 8 times with deionized water at 25° C. for 0.5 hour at each wash, at an 18 to 1 ratio of water to toner, then dried on a freeze dryer. The toner charge is tabulated in Table 1.

EXAMPLE 2

The filtered yellow Toner A particles were washed 8 times with deionized water that had been adjusted to pH=11 with KOH base addition, at 25° C. for 0.5 hour at each wash, at an 18 to 1 ratio of water to toner, then dried on a freeze dryer. The toner charge is tabulated in Table 1. Although the charge at 80 percent RH is slightly higher than that in Comparative Example 1, providing a lower more desirable relative humidity sensitivity, the charge at 20 percent RH is much lower, providing a low average charge level.

TONER EXAMPLE 3

The filtered yellow Toner A particles were washed 8 times with deionized water that had been adjusted to pH=11 with KOH, at an 18 to 1 ratio of water to toner, at 25° C. for 0.5 hour for each wash. This was followed by an ion exchange, whereby the toner was washed with $CaCl_2$ at 25° C. for 0.5 hour, at an 18 to 1 ratio of water to toner, then dried on a freeze dryer. The toner charge is tabulated in Table 1. The charge at 80 percent RH was significantly higher than either Comparative Example 1 or toner #2, providing a lower more desirable relative humidity sensitivity. While the charge at 20 percent RH was lower than Comparative Example 1, the average charge level was similar to Comparative Example 1, and the RH sensitivity was substantially reduced by a factor of four. The charge at both 20 and 80 percent RH for this Example was higher than in Example 2 with comparable low RH sensitivity.

TONER EXAMPLE 4

The filtered yellow Toner A particles were washed 8 times with deionized water that had been adjusted to pH=11 with KOH, at 45° C. for 0.5 hour for each wash, at an 18 to 1 ratio of water to toner. This was followed by an ion exchange step, whereby the toner was washed with $CaCl_2$ at 45° C. for 0.5 hour, at an 18 to 1 ratio of water to toner, then dried on a freeze dryer. The toner charge is tabulated in Table 1. The charge at 80 percent RH was significantly higher than either Comparative Example 1 or Example 2 providing a lower more desirable relative humidity sensitivity. The charge at 20 percent RH was also now much higher than the two Comparative Example 1 and Example 2, providing a higher average charge level than the Comparative Example.

TONER EXAMPLE 5

The filtered yellow Toner A particles were washed 8 times with deionized water that had been adjusted to pH=11 with KOH, at 45° C. for 0.5 hour for each wash, at an 18 to 1 ratio of water to toner. This was followed by an ion exhange step, whereby the toner was washed with a 1:1 molar ratio of KOH and $ZnCl_2$ at 45° C. for 0.5 hour, at an 18 to 1 ratio of water to toner, then dried on a freeze dryer. The toner charge is tabulated in Table 1. The charge at 80 percent RH was significantly higher than either Comparative Example 1 or Example 2. The charge at 20 percent RH was also now much higher than Comparative Example 1 and Example 2, providing a higher average charge level than the Comparative Example. In the Examples, "h" represents hours, for example 25° C. for 0.5 hour.

TABLE 1

Washing of a Yellow Toner with Base and Ion Exchange

| Example | Batch Washing Steps | Ion Exchange Step | Q/M 20% RH | Q/M 80% RH | Ave. Q/M | Q/M RH Ratio |
|---|---|---|---|---|---|---|
| Comparative Example 1 | 25° C./0.5 h 8 washes $H_2O$ | none | −14.2 | −2.2 | −8.2 | 6.5 |

TABLE 1-continued

Washing of a Yellow Toner with Base and Ion Exchange

| Example | Batch Washing Steps | Ion Exchange Step | Q/M 20% RH | Q/M 80% RH | Ave. Q/M | Q/M RH Ratio |
|---|---|---|---|---|---|---|
| Example 2 | 25° C./0.5 h/ pH = 11 8 washes KOH | none | −6.0 | −3.9 | 5.0 | 1.5 |
| Example 3 | 25° C./0.5 h/ pH = 11 8 washes KOH | 25° C./30' $CaCl_2$ | −11.4 | −6.6 | −9.0 | 1.7 |
| Example 4 | 45° C./0.5 h/ pH = 11 8 washes KOH | 45° C./30' $CaCl_2$ | −17.4 | −7.1 | −12.3 | 2.4 |
| Example 5 | 45° C./30/ pH = 11 8 washes KOH | 1:1 $K+/Zn^2+$ (KOH/ $ZnCl_2$) | −25.4 | −5.1 | −15.3 | 3.7 |

TONER EXAMPLE 6

The filtered cyan Toner B particles were washed 4 times with deionized water that had been adjusted to pH=9 with KOH at 25° C. for 2 hours at each wash, at an 18 to 1 ratio of water to toner, then dried on a freeze dryer. The toner charge is tabulated in Table 2.

TONER EXAMPLE 7

The filtered cyan Toner B particles were washed 4 times with deionized water that had been adjusted to pH=9 with KOH at 25° C. for 2 hours at each wash, at an 18 to 1 ratio of water to toner. This was followed by an ion exchange step, whereby the toner was washed with aqueous LiOH at pH=9 at 25° C. for 2 hours, at an 18 to 1 ratio of water to toner, then dried on a freeze dryer. The toner charge is tabulated in Table 2. The charge at 20 percent RH was significantly higher than the Example 6, while the charge at 80 percent RH was unchanged.

TABLE 2

Washing of a Cyan Toner with Base and Ion Exchange

| Example | Batch Washing Steps | Ion Exchange Step | Q/M 20% RH | Q/M 80% RH | Ave. Q/M | Q/M RH Ratio |
|---|---|---|---|---|---|---|
| Example 6 WH1 | 25° C./2 h/pH = 9 4 washes KOH | none | −9.4 | −6.0 | −7.7 | 1.6 |
| Example 7 WH2 | 25° C./2 h/pH = 9 4 washes KOH | 25° C./2 h/ pH 9 LiOH | −15.0 | −5.9 | −10.5 | 2.5 |

COMPARATIVE TONER EXAMPLE 8

The filtered cyan Toner C particles were washed five times with deionized water at 25° C., with a water to toner ratio of 2 to 1 by weight. The toner charge is tabulated in Table 3. Also shown in Table 3 is the surface tension of the wash water after the fifth washing step. The surface tension of the wash was a measure of the amount of surfactant left in the toner in that washing step. The initial value for the unwashed toner was 26 milliNewtons per centimeter, while pure water had a surface tension of about 65 milliNewtons per centimeter.

TONER EXAMPLE 9

The filtered cyan Toner C particles were washed with deionized water adjusted to pH=9 with NaOH, and with a water to toner ratio of 2 to 1 by weight. This was followed by an ion exchange step, whereby the toner was washed with deionized water four times, with a water to toner ratio of 2 to 1 by weight, and then dried on a freeze dryer. The toner charge is tabulated in Table 3. The charge at both 20 percent RH and at 80 percent RH was significantly higher than the Comparative Example 8. Also shown in Table 3 is the surface tension of the wash water after the fifth wash, which was 57 milliNewtons per centimeter, close to the value for pure water, and much higher than the value for the Comparative Toner Example 8. The much higher surface tension, for the same number of washes, indicated that this toner was washed of surfactant more effectively and superior to that of the toner of Comparative Example 8.

TABLE 3

Washing of a Cyan Toner with Base and Ion Exchange

| Toner Example | Washing Steps | Ion Exchange Steps | Wash Water Surface Tension After 5 Washes | Q/M 20% RH | Q/M 80% RH | Q/M RH Ratio |
|---|---|---|---|---|---|---|
| Comparative Example 8 | 25° C. 5 washes $H_2O$ | none | 45 | −12.0 | −3.0 | 4.0 |
| Example 9 | 25° C./ pH = 9 1 wash NaOH | 25° C. 4 washes $H_2O$ | 57 | −17.0 | −6.6 | 2.5 |

COMPARATIVE TONER EXAMPLE 10

The filtered yellow Toner A particles were washed eight times at 25° C. for 0.5 hour with deionized water that had been adjusted to pH=11 with KOH, at an 18 to 1 ratio of water to toner, then dried on a freeze dryer. The toner charge is tabulated in Table 4.

COMPARATIVE TONER EXAMPLE 11

The washed and dried yellow Toner A particles of Comparative Toner Example 10 were dry blended with silica. To 10 grams of the silica in a 120 milliliter glass bottle were added 200 milligrams of Degussa R974 silica. 100 Grams of steel shot were added to the jar as a milling aid, and the silica was roll milled onto the toner at 90 feet/minute for 35 minutes. The dispersion of the silica onto the toner surface was confirmed by SEM. The toner charge is tabulated in Table 4. While the toner charge was higher at both 20 percent RH and 80 percent RH, the ratio of charge between 20 percent RH and 80 percent RH was very large, a factor of 2.7, higher than desired. The charge at 20 percent RH was much higher than desired, as the toner is now very difficult to remove from the carrier. This high charge is known to result in very poor xerographic image development, and with very low developed toner mass per unit area. Although the high charge at 20 percent RH could be reduced by reduction in the amount of silica utilized, this would also decrease the charge at 80 percent RH to unacceptable levels.

TONER EXAMPLE 12

The filtered yellow Toner A particles were washed eight times with deionized water that had been adjusted to pH=11 with KOH at 25° C. for 0.5 hour, at an 18 to 1 ratio of water to toner. The toner particles were then washed with 2 weight percent of R974 silica suspended in water that had been adjusted to pH=11 with KOH, for 0.5 hour, at an 18 to 1 ratio of water to toner, then dried on a freeze dryer. The dispersion of the silica onto the toner surface was confirmed by SEM. The amount of silica on the toner was measured by observing the silica using FT Infrared Spectroscopy. The amount found was 1.9 weight percent. The toner charge is tabulated in Table 4. The charge at both 20 percent RH and 80 percent RH was much higher than in the Comparative Toner Example 10. The charge at 80 percent RH was somewhat lower than that of Comparative Toner Example 11, but the charge at 20 percent RH was now also much improved than with the dry blended silica, providing an RH sensitivity ratio of only 1.5, approximately a factor of two better than for the Comparative Toner Example 11. Both the invention toner charge at 20 percent RH and 80 percent RH are within a preferred range of charge.

The aging rate of Toner Example 12 is compared to the aging rate of Comparative Toner Example 11 in FIG. 1. In a 250 milliliter glass bottle, 4 grams of the toner were added to 96 grams of carrier particles comprised of 65 micron steel particles coated with a mixture of 20 percent by weight of VULCAN carbon black and 80 weight percent of polymethylmethacrylate, coating weight of 1 percent. The toner and carrier were retained in a environmental chamber at 50 percent relative humidity overnight, about 18 hours. The bottle was then sealed, and the toner and carrier particles were mixed on a paint shaker for intervals of 10, 20, 30, 40 and 60 minutes. At each time interval a sample, about 3 grams, of developer was taken to measure the toner charge using the standard tribo blow-off apparatus. The aging rate of the two toners was the same from 20 minutes to 60 minutes, however, the Comparative Toner Example 11 evidenced a higher than initial aging rate up to 20 minutes than does the inventive toner of Example 12.

TABLE 4

Washing of a Yellow Toner With Base and In Situ Silica EA1-41-Y1 (Exp 1-C8) 8X KOH

| Example | Washing | Metal Oxide Added | Q/M 20% RH | Q/M 80% RH | Q/M RH Ratio |
|---|---|---|---|---|---|
| Comparative Example 10 | 25° C./0.5 h 8 washes KOH | none | −6 | −3.9 | 1.5 |
| Comparative Example 11 | 25° C./0.5 h 8 washes KOH | 2% dry-blended R974 | −70 | −26 | 2.7 |
| Example 12 | 25° C./0.5 h 8 washes KOH | 2% in situ R974 in KOH solution | −27 | −18 | 1.5 |

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising:

(i) preparing a pigment dispersion, which dispersion is comprised of a pigment, and an ionic surfactant;

(ii) shearing said pigment dispersion with a latex or emulsion blend comprised of resin, a counterionic surfactant with a charge polarity of opposite sign to that of said ionic surfactant and a nonionic surfactant, and wherein said resin contains an acid functionality;

(iii) heating the above sheared blend below about the glass transition temperature (Tg) of the resin to form electrostatically bound toner size aggregates;

(iv) adding anionic surfactant to stabilize the aggregates obtained in (iii);

(v) coalescing said aggregates by heating said bound aggregates above about the Tg of the resin;

(vi) reacting said resin of (v) with acid functionality with a base to form an acrylic acid salt, and which salt is ion exchanged in water with a base or a salt, optionally in the presence of metal oxide particles, to control the toner triboelectrical charge, which toner is comprised of resin and pigment; and (vii) optionally drying the toner obtained.

2. A process in accordance with claim 1 wherein the acid functionality is acrylic acid.

3. A process in accordance with claim 1 wherein the resin is a styrene acrylate, and the base is an alkali metal hydroxide.

4. A process in accordance with claim 1 wherein a base of an alkali metal hydroxide is selected.

5. A process in accordance with claim 1 wherein the salt used in the ion exchange is a metal halide.

6. A process in accordance with claim 1 wherein the reaction between the toner resin of (vi) and the base is accomplished at a temperature of from about 0° C. to about 5 to 10 degrees below the glass transition temperature of the resin, over a period of about 10 minutes to about 6 hours, and where the pH of the water is between about 7 and about 13.

7. A process in accordance with claim 1 wherein the base treated toner is ion exchanged in water, at a temperature of from about 0° C. to about 5 to 10 degrees below the glass transition temperature of the resin, over a period of time of from about 15 minutes to about 6 hours.

8. A process in accordance with claim 1 wherein the base is sodium hydroxide, and the resin is a styrene acrylate acrylic acid.

9. A process in accordance with claim 1 wherein the base is potassium hydroxide, and the resin is a styrene acrylate acrylic acid.

10. A process in accordance with claim 1 wherein the ion exchange salt is a metal halide, and the resin is a styrene acrylate acrylic acid.

11. A process in accordance with claim 1 wherein the ion exchange salt is $ZnCl_2$ and the resin is a styrene acrylate acrylic acid, or wherein the ion exchange salt is $CaCl_2$, and the resin is a styrene acrylate acrylic acid.

12. A process in accordance with claim 1 wherein there are utilized metal oxide particles selected from a group consisting of silicon dioxide, titanium dioxide, tin oxide, aluminum oxide, and zirconium oxide, and the resin is a styrene acrylate acrylic acid.

13. A process in accordance with claim 1 wherein there are utilized metal oxide particles of hydrophobically modified silicon dioxide, and the resin is a styrene acrylate acrylic acid.

14. A process in accordance with claim 1 wherein the surfactant utilized in preparing the pigment dispersion is a cationic surfactant, and the counterionic surfactant present in the latex mixture is an anionic surfactant.

15. A process in accordance with claim 1 wherein the surfactant utilized in preparing the pigment dispersion is an anionic surfactant, and the counterionic surfactant present in the latex mixture is a cationic surfactant.

16. A process in accordance with claim 1 wherein said toner triboelectric charge is from about 5 to about 50 microcoulombs per gram.

17. A process in accordance with claim 1 wherein the heating of the statically bound aggregate particles to form toner size composite particles comprised of pigment, and reacted resin product is accomplished at a temperature of from about 10° C. above the Tg of the resin to about 95° C. for a duration of from about 1 hour to about 8 hours.

18. A process in accordance with claim 1 wherein the resin is selected from the group consisting of poly(styrene-butadiene), poly(para-methyl styrene-butadiene), poly(meta-methylstyrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methylstyrene-isoprene), poly(meta-methylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), all containing optionally acrylic acid.

19. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; the anionic surfactant is selected from the group consisting of sodium dodecyl sulfate, sodium dodecylbenzene sulfate and sodium dodecylnaphthalene sulfate; and the cationic surfactant is a quaternary ammonium salt.

20. A process in accordance with claim 1 wherein the pigment is carbon black, magnetite, cyan, yellow, magenta, or mixtures thereof.

21. A process in accordance with claim 1 wherein the resin utilized in (ii) is from about 0.01 to about 3 microns in volume average diameter, and the pigment is from about 0.01 to about 3 microns in volume average diameter.

22. A process in accordance with claim 1 wherein the toner isolated is from about 2 to about 15 microns in average volume diameter, and the geometric size distribution thereof is from about 1.15 to about 1.35.

23. A process in accordance with claim 1 wherein the aggregates formed in (v) are about 1 to about 10 microns in volume average diameter.

24. A process in accordance with claim 1 wherein the nonionic surfactant concentration is from about 0.1 to about 5 weight percent, the anionic surfactant concentration is about 0.1 to about 5 weight percent, and the cationic surfactant concentration is about 0.1 to about 5 weight percent of the toner components of resin, pigment and charge agent.

25. A process in accordance with claim 1 wherein there is added to the surface of the formed dried toner metal salts, metal salts of fatty acids, silicas, metal oxides, or mixtures thereof, each in an amount of from about 0.1 to about 10 weight percent of the obtained toner of resin and pigment.

26. A process in accordance with claim 1 wherein said resin of (ii) is submicron in volume average diameter, the sheared blend of (iii) is continuously stirred, and subsequent to (v) said toner is separated by filtration and subjected to drying.

27. A process in accordance with claim 1 wherein heating in (iii) is from about 5° C. to about 25° C. below the Tg, heating in (iii) is accomplished at a temperature of from about 29° to about 59° C., or the resin Tg in (iii) is from about 50° to about 80° C., heating in (iv) is from about 5° to about 50° C. above the Tg, or the resin Tg is 54° C. and heating in (iv) is from about 59° to about 104° C.

28. A process in accordance with claim 27 wherein the heating in (iii) is equal to or slightly above the resin Tg.

29. A process for the preparation of toner comprising:

(i) preparing, or providing a pigment dispersion, which dispersion is comprised of a pigment, and an ionic surfactant;

(ii) shearing said pigment dispersion with a latex blend comprised of resin, a counterionic surfactant with a charge polarity of opposite sign to that of said ionic surfactant and a nonionic surfactant, and wherein said resin contains an acid functionality;

(iii) heating the above sheared blend below about the glass transition temperature (Tg) of the resin to form aggregates;

(iv) adding anionic surfactant;

(v) heating said aggregates above about the Tg of the resin;

(vi) reacting in the presence of a metal oxide said resin with acid functionality with a base to form an acrylic acid salt; and optionally (vii) isolating and drying the toner.

30. A process in accordance with claim 29 wherein in (vi) said acrylic acid salt is ion exchanged in water with a base or a salt, in the presence of the metal oxide.

31. A process for the preparation of toner comprising shearing a pigment dispersion with a latex blend, and wherein the pigment dispersion is comprised of a pigment and an ionic surfactant, and wherein the latex blend is comprised of resin, a counterionic surfactant with a charge polarity of opposite sign to that of said ionic surfactant and a nonionic surfactant, and wherein said resin contains an acid functionality; heating the above sheared blend below about the glass transition temperature (Tg) of the resin to form aggregates; adding anionic surfactant to stabilize the formed aggregates; heating said aggregates above about the Tg of the resin to effect coalescence thereof; reacting said resin with acid functionality with a base to form an acrylic acid salt; and optionally isolating and drying the toner.

32. A process in accordance with claim 31 wherein the toner is isolated and dried, and the salt ion exchange is accomplished in the presence of metal oxides, or a metal oxide.

33. The toner obtained by the process of claim 31.

34. A process in accordance with claim 31 wherein heating in (iii) and (v) is about at the resin Tg.

* * * * *